US009456944B2

(12) United States Patent
Berg et al.

(10) Patent No.: US 9,456,944 B2
(45) Date of Patent: Oct. 4, 2016

(54) PATIENT SLING

(71) Applicant: Arjo Hospital Equipment AB, Eslov (SE)

(72) Inventors: Eva Berg, Lund (SE); Anette Lindell, Flyinge (SE); Emma Olsson, Klagerup (SE)

(73) Assignee: HUNTLEIGH TECHNOLOGY LIMITED (GB)

( * ) Notice: Subject to any disclaimer, the term of this patent is extended or adjusted under 35 U.S.C. 154(b) by 0 days.

(21) Appl. No.: 14/493,285

(22) Filed: Sep. 22, 2014

(65) Prior Publication Data

US 2015/0074903 A1 Mar. 19, 2015

Related U.S. Application Data

(63) Continuation-in-part of application No. PCT/EP2013/055167, filed on Mar. 13, 2013.

(30) Foreign Application Priority Data

Mar. 22, 2012 (EP) ..... 12160698

(51) Int. Cl.

| | |
|---|---|
| ***A61G 7/14*** | (2006.01) |
| ***A61G 7/10*** | (2006.01) |
| ***A47G 9/02*** | (2006.01) |

(52) U.S. Cl.

CPC ..... *A61G 7/1051* (2013.01); *A47G 9/0238* (2013.01); *A61G 7/1013* (2013.01); *A61G 7/1055* (2013.01); *A61G 7/1057* (2013.01); *A61G 7/1073* (2013.01)

(58) Field of Classification Search

CPC ..... A61G 7/14

USPC ..... 5/83.1, 81.1 T, 81.1 R, 89.1

See application file for complete search history.

(56) References Cited

U.S. PATENT DOCUMENTS 1,438,921 A 12/1922 King
2,763,875 A 9/1956 Piontkowski (Continued)

FOREIGN PATENT DOCUMENTS

CA 1266449 A 3/1990
DE 19501225 A1 7/1996

(Continued)

OTHER PUBLICATIONS

International Search Report for corresponding International Patent Application No. PCT/EP2013/055167, dated Jun. 21, 2013, 2 pages.

(Continued)

*Primary Examiner* — Fredrick Conley

(74) *Attorney, Agent, or Firm* — Wesley Scott Ashton; Kirk Swenson; Grace Doe

(57) ABSTRACT

The patient transfer acts as a combined sling and bed cover and includes a substantially rectangular sheet portion of a size to fit over a standard bed mattress and to which are attached a plurality of straps for coupling to a hoist. The patient transfer sheet is preferably made of a single-layered material which is breathable, strong and soft. The patient transfer sheet can act as a sling for transportation/repositioning of a patient as well as a replacement bed covering to replace conventional bed linen. The patient can thus be transported onto a bed without needing to remove the patient from the sling.

21 Claims, 8 Drawing Sheets

(56) References Cited

U.S. PATENT DOCUMENTS

| | | | | |
|---|---|---|---|---|
| 3,284,816 | A | 11/1966 | Laubsch | |
| 3,813,712 | A | 6/1974 | Bonnin | |
| 3,849,813 | A | 11/1974 | Neilson | |
| 4,070,721 | A | 1/1978 | Stasko | |
| 4,092,748 | A | 6/1978 | Ewers | |
| 4,675,925 | A | 6/1987 | Littleton | |
| 4,744,115 | A | 5/1988 | Marchione | |
| 4,822,667 | A | 4/1989 | Goad et al. | |
| 4,843,665 | A | 7/1989 | Cockel et al. | |
| 5,121,514 | A | 6/1992 | Rosane | |
| 5,155,874 | A | 10/1992 | Kershaw | |
| 5,165,122 | A | 11/1992 | Phalen | |
| 5,329,655 | A | 7/1994 | Garner | |
| 5,396,669 | A | 3/1995 | Nieminen | |
| 5,442,821 | A | 8/1995 | Weeks | |
| 5,577,281 | A | 11/1996 | Mital et al. | |
| 5,615,426 | A * | 4/1997 | Hokett | 5/89.1 |
| 5,638,562 | A | 6/1997 | Masoncup | |
| 5,673,443 | A | 10/1997 | Marmor | |
| 5,754,992 | A | 5/1998 | Melnick et al. | |
| 5,920,929 | A * | 7/1999 | Hensley | A61G 7/1023 5/485 |
| 6,131,215 | A | 10/2000 | Lindell | |
| 6,196,229 | B1 | 3/2001 | Piazza | |
| 6,341,393 | B1 | 1/2002 | Votel | |
| 6,349,432 | B1 | 2/2002 | Scordato et al. | |
| 6,591,435 | B1 | 7/2003 | Hodgetts | |
| 6,658,676 | B1 * | 12/2003 | Persson et al. | 5/81.1 HS |
| 7,676,863 | B2 | 3/2010 | Henning | |
| 2002/0010960 | A1 | 1/2002 | Friedrich | |
| 2003/0110560 | A1 | 6/2003 | Friel et al. | |
| 2004/0148699 | A1 | 8/2004 | Fernie et al. | |
| 2004/0221388 | A1 | 11/2004 | Votel | |
| 2005/0103350 | A1 | 5/2005 | Henry | |
| 2005/0132495 | A1 | 6/2005 | Girard et al. | |
| 2006/0150322 | A1 | 7/2006 | Schrepfer | |
| 2006/0213010 | A1 | 9/2006 | Davis | |
| 2007/0022534 | A1 | 2/2007 | Richards | |
| 2007/0056096 | A1 | 3/2007 | Assink | |
| 2008/0209630 | A1 | 9/2008 | Kazala et al. | |
| 2008/0216232 | A1 | 9/2008 | White et al. | |
| 2008/0301873 | A1 * | 12/2008 | White | A61G 7/001 5/85.1 |
| 2009/0144894 | A1 | 6/2009 | Shiffert | |
| 2010/0043141 | A1 | 2/2010 | Short et al. | |
| 2010/0199425 | A1 * | 8/2010 | Lee | A61G 7/001 5/85.1 |
| 2013/0167847 | A1 | 7/2013 | Rogers | |
| 2013/0227789 | A1 | 9/2013 | Olson et al. | |
| 2014/0182059 | A1 | 7/2014 | Jonsson | |
| 2014/0317843 | A1 | 10/2014 | Martin | |
| 2015/0047120 | A1 | 2/2015 | Partridge et al. | |
| 2015/0047121 | A1 | 2/2015 | Berg et al. | |

FOREIGN PATENT DOCUMENTS

| | | | |
|---|---|---|---|
| DE | 29803192 | U1 | 2/1998 |
| FR | 2 403 074 | A1 | 4/1979 |
| GB | 2294883 | A | 5/1996 |
| GB | 2303331 | A | 2/1997 |
| GB | 2338700 | A | 12/1999 |
| GB | 2410193 | A | 7/2005 |
| JP | 8019578 | A | 1/1996 |
| JP | 2002-065764 | A | 3/2002 |
| JP | 2006-198369 | A | 8/2006 |
| JP | 2006-263314 | A | 10/2006 |
| JP | 2010-252898 | A | 11/2010 |
| WO | 01/12028 | A1 | 2/2001 |
| WO | 2004/050002 | A1 | 6/2004 |
| WO | 2010/020818 | A2 | 2/2010 |
| WO | 2010/061230 | A1 | 6/2010 |

OTHER PUBLICATIONS

Nassif, Gadah All Abou, "Effect of Weave Structure and Weft Density on the Physical and Mechanical Properties of Micro polyester Woven Fabrics", Life Science Journal, 2012, vol. 9, No. 3, pp. 1326-1331.

Ramakrishnan, G., et al., "An Investigation Into the Properties of Knitted Fabrics Made From Viscose Microfibers", Journal of Textile and Apparel, Technology and Management, Spring 2009, vol. 6, Issue 1, pp. 1-9.

Pressure Ulcer Prevention: Quick Reference Guide, European Pressure Ulcer Advisory Panel (EPUAP) and National Pressure Ulcer Advisory Panel (NPUAP), Washington, D.C., 2009, 26 pages.

International Guideline: Pressure Ulcer Treatment Technical Report, National Pressure Ulcer Advisory Panel & European Pressure Ulcer Advisory Panel, 2009, pp. 1-168.

ArjoHuntleigh Getinge Group Maxi Transfer Sheet: Instructions for Use, Nov. 11, 2013, 36 pages.

ArjoHuntleigh Getinge Group Maxi Transfer Sheet: Setting New Lateral Transfer Standards, Apr. 28, 2014, 6 pages.

The American Heritage Desk Dictionary (1981), 304, Houghton Mifflin Company, Boston, MA.

The American Heritage Desk Dictionary (1981), 677 and 761, Houghton Mifflin Company, Boston, MA.

U.S. Census Bureau, Statistical Abstract of the United States: 2012, Oct. 2011, Cumulative Percent Distribution of Population by Weight and Sex: 2007-2008, http://web.archive.org/web/20111017184749/http://www.census.gov/compendia/statab/2012/tables/12s0210.pdf.

European Search Report issued for corresponding European Patent Application No. 12160698.2, dated Aug. 9, 2012, 2 pages.

Non-Final Office Action issued for related U.S. Appl. No. 14/387,214, dated Apr. 2, 2015, 43 pages.

Final Office Action issued for related U.S. Appl. No. 14/387,214, dated Oct. 7, 2015, 31 pages.

Bedding—Wikipedia, downloaded Jun. 2, 2015, http://en.wikipedia.org/w/index.php?title=Bedding&oldid=663528094.

Non-Final Office Action issued for related U.S. Appl. No. 14/387,214, dated Apr. 28, 2016 (34 pages).

* cited by examiner

PATIENT SLING

CROSS-REFERENCE TO RELATED APPLICATIONS

The present application is a continuation-in-part application filed under 35 USC §111(a), and claims the benefit under 35 U.S.C. §371 of PCT International Application No. PCT/EP2013/055167, filed Mar. 13, 2013 titled "Patient Sling" and which designated the United States of America, and which claims the benefit of priority to European Patent application serial No. EP12160698.2 filed on Mar. 22, 2012 now published as EP2641578A1, the entire contents of which are hereby incorporated by reference.

FIELD

The present invention relates to a patient sling and in particular to a combined patient sling and mattress sheet.

BACKGROUND

Patient slings are known for carrying incapacitated patients from one location to another, for example from an operating theatre trolley, a wheelchair or other patient support, to a patient bed. In addition, the slings can also be used to reposition patients in bed e.g. moving up in bed or turning. Such slings need to be conformable for patient comfort and strong to be able to support the patient. Difficulties arise with the movement of incapacitated patients, particularly in transferring them onto and off the sling.

SUMMARY

Embodiments of the present disclosure seek to provide an improved patient sling.

According to an example embodiment, there is provided a combined patient sling and bed covering including a substantially rectangular sheet and a plurality of coupling elements fixed to the substantially rectangular sheet for attachment to a lifting device (such as a hoist).

A combined patient sling and bed covering provides numerous advantages over the art, particularly in the care of incapacitated patients, by avoiding the need to transfer the patient off the sling and onto a bed, which causes difficulties for the care workers and discomfort to the patient. Furthermore, a patient can be lifted from a bed by using what in effect is the bed sheet without having to transfer the patient onto a separate sling.

The sheet may be made of a single layer of material, thereby to conform with The International Pressure Ulcer Treatment and Prevention Guidelines. The sling taught herein will therefore act as a standard bed sheet when not being used as a sling.

Advantageously, the sheet will be of a strength to be able to support the weight of a patient, in particular a weight of at least 75 kilograms and preferably a weight in excess of 100 kilograms. The sheet preferably has a length L (sh) of at least 170 cm and a width W (sh) of at least 70 cm. In other words, the sheet will have dimensions at least as big as a bed mattress having a width W (m) and a length L(m).

According to an example embodiment, all or a portion of the sheet is substantially free of surface characteristics across the majority of its extent, including for instance that portion of the sheet a patient would rest on while resting on the mattress for an extended period of time. In other words, the sheet provides an undisturbed surface, at least within the region or zone the patient would exert pressure while resting, preferably with no protrusions, no stitch lines or seams, particularly across the part of the sheet which overlies the mattress including for instance the upper surface portion of the mattress. The coupling elements and any other features of the sheet may be located at or towards the edges of the sheet and in practice lie outside of the upper contact surface of the sheet so as not to get caught under a laying patient.

The coupling elements are preferably disposed along longitudinal sides of the sheet and may be substantially evenly spaced along the longitudinal sides.

In an embodiment, there may be provided at least one coupling element disposed along at least one transverse side, or end, of the sheet. This coupling element would preferably be located at the foot and/or head end of the sheet and be used to support and hold the feet/legs and/or head of a patient.

Advantageously, the coupling elements include straps. The straps may be attached to the sheet, while in another embodiment the straps may be removable and attachable, for instance by hooks or the like on the sheet. Preferably, the straps are adjustable in length.

Embodiments of the present disclosure include a reinforcement element extending along the sides of the sheet.

Advantageously, there are provided first and second side valences attached to, integral with or attachable to the longitudinal sides of the sheet. The coupling elements are advantageously accessible when the side valances are attached to the sheet. In this regard, the coupling elements may at least partially extend over the side valances.

The sheet may be made of a breathable fabric. This may be a manmade fabric such as polyester and polyamide or a natural material such as cotton, linen/flax or silk. The sheet may be woven, knitted or a nonwoven. The sheet may be washable or non-washable, i.e. specific to a patient.

According to another aspect of the present invention, there is provided a method of moving a patient in a care environment including the steps of providing a combined patient sling and bed covering which includes a substantially rectangular sheet and a plurality of coupling elements for attachment to a lifting device; lifting the patient in the combined patient sling and bed sheet by means of a lifting device to over a bed, lowering the patient onto the bed, detaching the combined sling and bed covering from the lifting device, such that the patient comes to rest on the bed with the combined sling and bed covering acting as a bed sheet. Prior to and/or after moving the patient, the patient may rest on the sling and bed covering for an extended period of time. The extended period of time including but not limited to 6 hours, 12 hours, 24 hours, 48 hours, 72 hours, and six days. This time is substantially continuous (e.g., may involve essentially no or only minimal gross movement to or from the bed), and in other scenarios is continuous. The extended period of time may also (or in addition to) be a sufficient amount of time to cause redness, irritation and/or tissue breakdown that would lead to one or more decubitus ulcers.

Preferably, the method includes the step of providing or attaching side valances to the sheet, which may be positioned to substantially hide one or more, or even all, of the coupling elements. In embodiments where the valence is integral or already attached, the method involves moving one or both of the valences from a position hanging vertically from the bed to a position at least partially covering the patient while the patient is positioned on the sheet.

BRIEF DESCRIPTION OF THE DRAWINGS

Embodiments of the present invention are described below, by way of example only, with reference to the accompanying drawings, in which.

DESCRIPTION OF EMBODIMENT(S)

Figure 1:
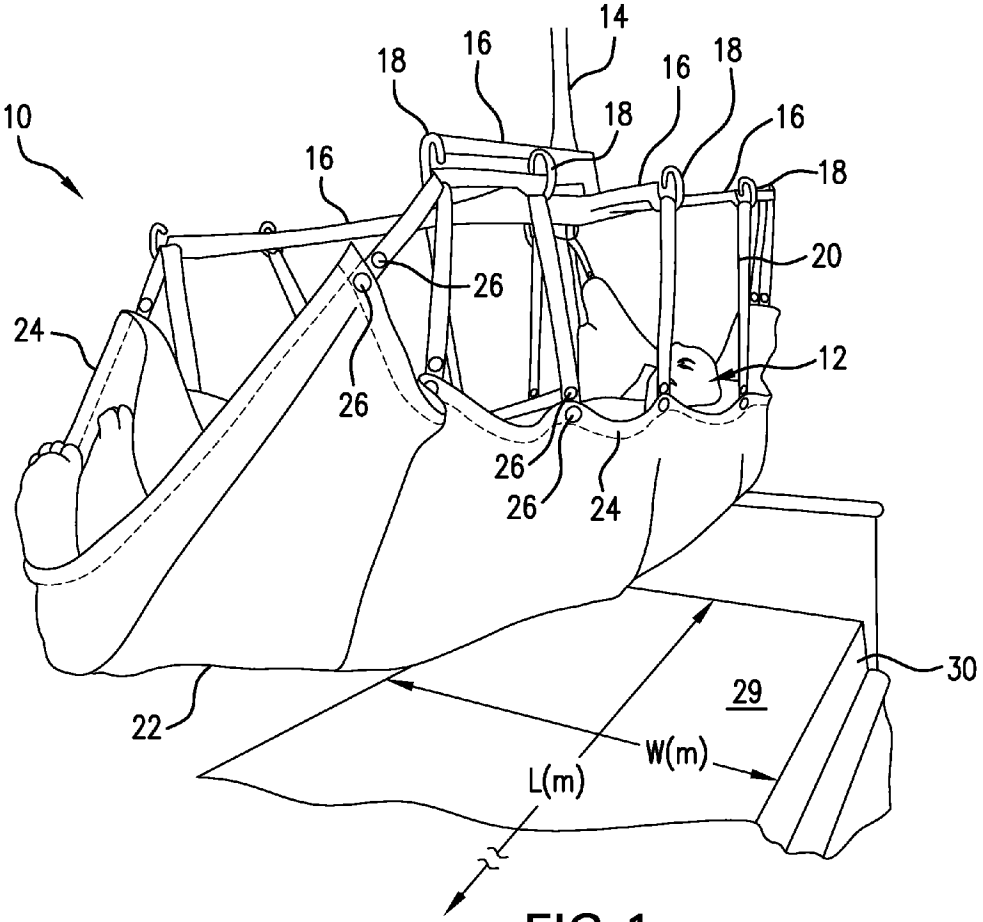
FIG. 1 is a perspective view of a preferred embodiment of patient sling and bed cover, in use with a hoist according to an example embodiment of the present disclosure.

Referring to FIG. 1, there is shown a preferred embodiment of combined sling and bed cover 10 in use and hereinafter referred to as transfer sheet 10. The transfer sheet 10 is shown holding a patient 12 in a lying position and being attached a hoist 14. The hoist 14 typically includes frame having a plurality of transversally extending arms 16 ending in hooks/lugs 18 which hold straps 20 of the transfer sheet 10. The transfer sheet 10 is preferably of dimensions that it can comfortably hold a patient 12, typically having a length of at least 170 cm and a width of at least 70 cm. The transfer sheet 10 may have a length longer than the length of the underlying mattress and may be longer by at least 4 cm, more preferably 14 cm and ever more preferably 24 cm. Other lengths are possible. For instance, a bed mattress having a length L(m) of 220 cm may be covered by a transfer sheet 10 having a length L (sh) of at least 220 cm, possibly even 244 cm. Example widths of the transfer sheet 10 (not including any valence width) are about at least 3 cm larger than the width of the mattress the transfer sheet 10 is to overlay. For instance, for a bed having a width W(m) of 93 cm, the transfer sheet 10 (not including valence width) would desireably have a width W(sh) of 96 cm. Short or larger widths are possible. In another embodiment, for a bed having a width W(m) of 122 cm, the transfer sheet 10 would have a width W(sh) of about 125 cm. Valence dimensions for use with the aforementioned sizes may include for instance a width W(v) 40 cm per valence, and may also include other dimensions such as widths of at least 15 cm per valence, and more than or less than 40 cm per valence per side. The associated length of a valence may be the same as or about the same as that as the transfer sheet 10. In certain embodiments, the valence has a continuous and non-interrupted edge 53 on each side of the transfer sheet 10 (i.e., from end to end).

In various embodiments, straps 20 are included and have a length which enables the transfer sheet 10 to hang in a substantially horizontal position with the patient 12 held inside. In order to accommodate for different designs of hoist 14 as well as different patients, the straps 20 may be adjustable in length by any well-known mechanism. Additionally, straps 20 having multiple latching locations may be employed such that the user can connect each strap to one of a variety of locations, thereby establishing different lengths of strap usage.

Figure 2:
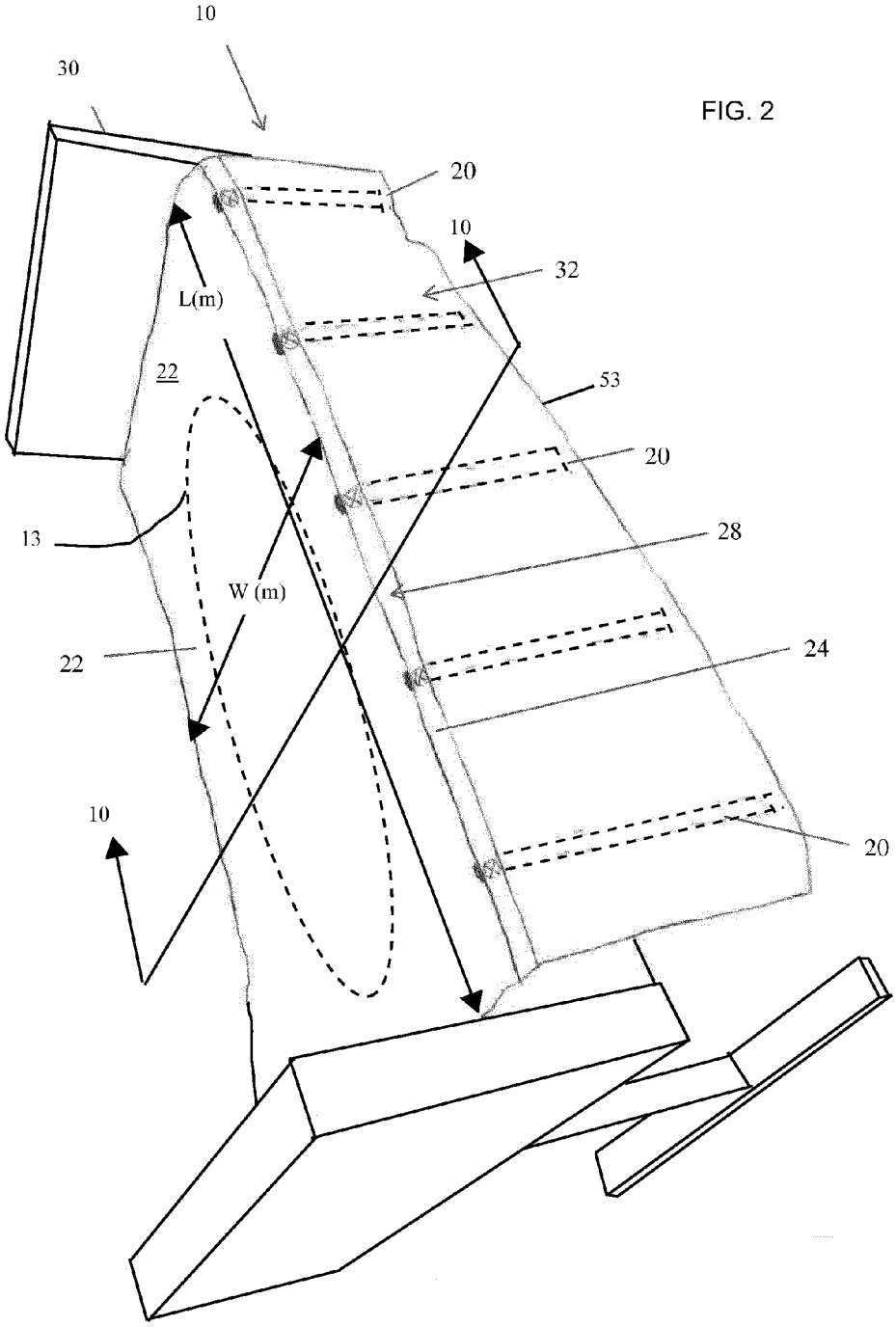
FIG. 2 is a view of the patient sling and bed cover draped over a bed (including the bed's mattress), in particular a standard-sized hospital bed mattress, according to an example embodiment.
Figure 6:
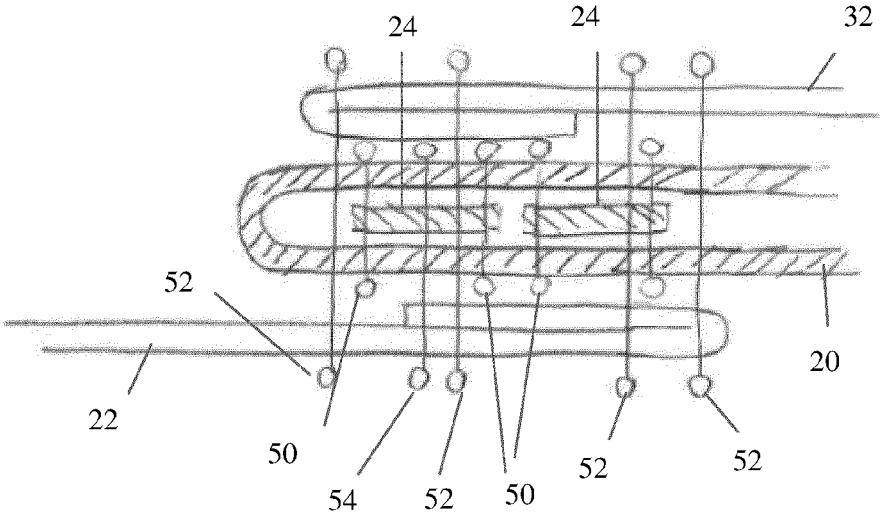
Figure 7:
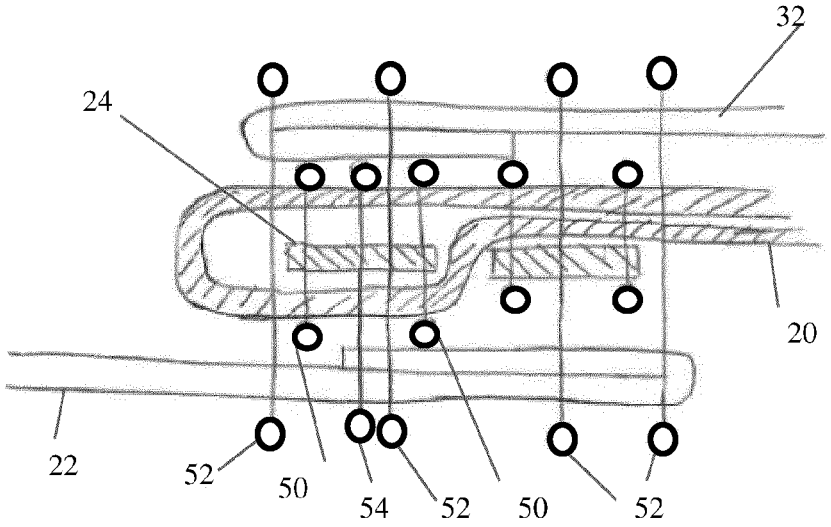
Figure 8:
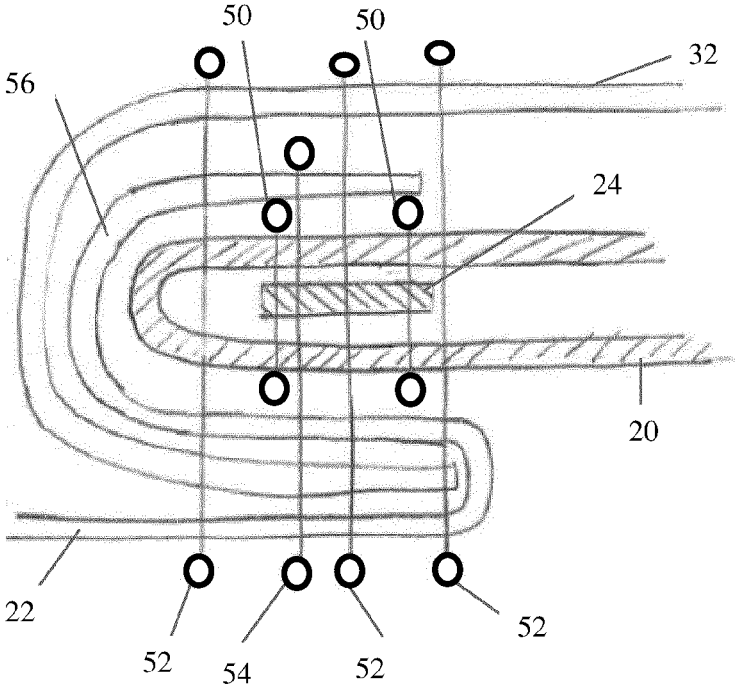

As can be seen in particular in FIG. 1 but also with reference to FIG. 2 and FIGS. 7 and 8, the transfer sheet 10 includes a first substantially rectangular sheet portion 22 which is advantageously reinforced by webbing or other material 24 extending around the perimeter of the portion 22. The webbing 24 can be stitched to the sheet portion 22 and may also be circle stitched to the straps 20 by stitching 26. Various types of stitching are disclosed below with reference to FIGS. 4 to 8. In various embodiments, the straps 20 are not shown to cross from one edge 28 of the sheet portion 22 to the other edge 28 for at least that portion of the sheet 22 in which a patient may be expected to make contact with while resting on the bed for an extended period of time.

The sheet portion 22 is preferably made of a breathable material, including man-made materials such as polyester and polyamide or natural materials such as cotton linen/flax, silk or similar. It is advantageous that the fabric has wicking properties and is also anti-static to prevent patient discomfort as well as interference with electrical equipment which may be used on, in or around the bed. For example, a fabric that minimizes friction and traction (shear), and that facilitates the wicking away of body moisture, is desirable because friction, traction, shear and moisture are factors that contribute to decubitus ulcer formation.

One such fabric having desirable low-friction properties, and characteristics that minimize traction and/or shear, is microfiber material. Such a microfiber material is woven tightly from synthetic fibers that measure less than one denier, so the fibers are substantially thinner than conventional normal denier viscose yarns that have a denier of greater than one denier. These man-made fibers are formed of polyesters, poly amides (nylon), and/or a conjugation of both polyesters and poly amides. Such microfiber materials are soft and substantially wrinkle resistant. Twill or satin weave structures provide the smoothest surfaces that are substantially free of surface irregularities. Microfibers that are 100% polyester with an antistatic yarn in warp is an example of a microfiber material usable for the present disclosure.

The transfer sheet 10 (including its base fabric structure) is made of a fabric sufficiently strong to support the weight of a patient 12, that is preferably a weight of at least 75 kg and most preferably at least 100 kg. Furthermore, as will be evident from FIGS. 1 and 2 in particular, at least the rectangular sheet element 22 is advantageously made of a drapable and generally smooth material, that is a material without significant burrs or other surface irregularities which may cause discomfort to a patient 12, increase friction and/or traction/shear, or otherwise promote the formation of decubitus ulcers.

Figure 9A:
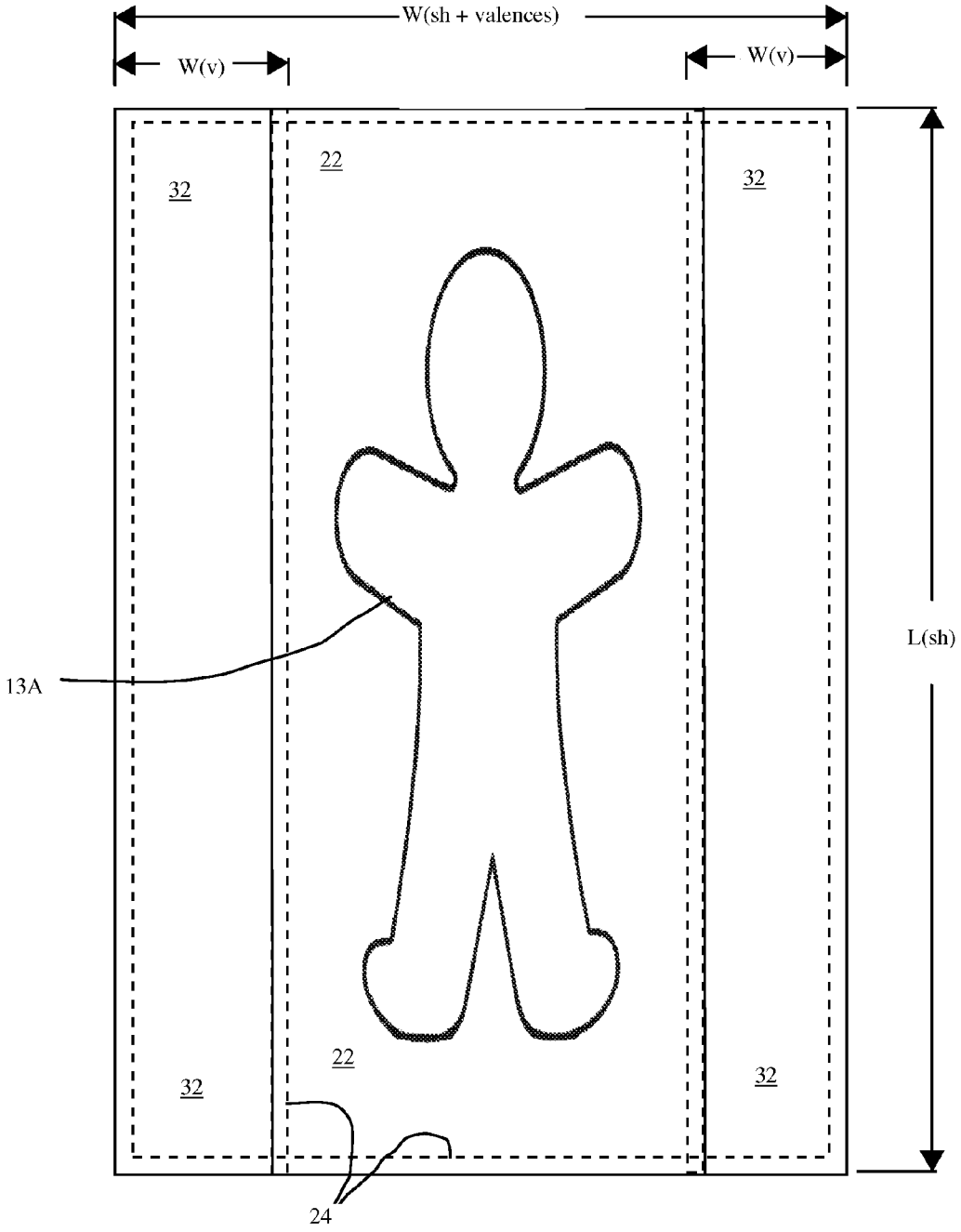
FIG. 9A shows a front facing view of a patient sling and bed cover oriented in a flat manner, as well as a central patient contact region or zone, generally delimited by border 13A, according to an embodiment of the present disclosure.
Figure 9B:
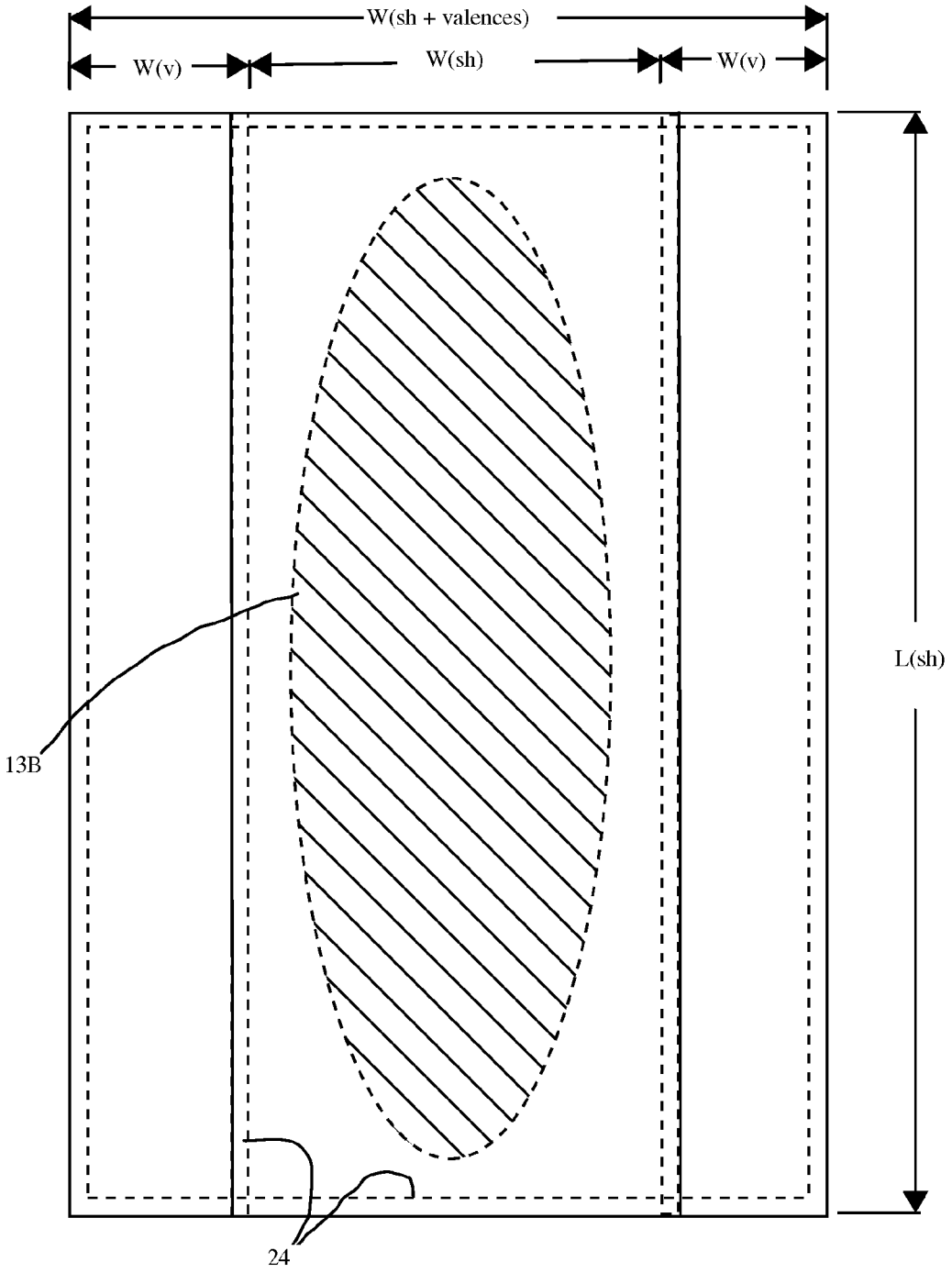
FIG. 9B shows a front facing view of a patient sling and bed cover oriented in a flat manner, as well as a central patient contact region or zone, generally shaped as an ellipse and generally delimited by border 13B, according to an embodiment of the present disclosure.
Figure 10A:
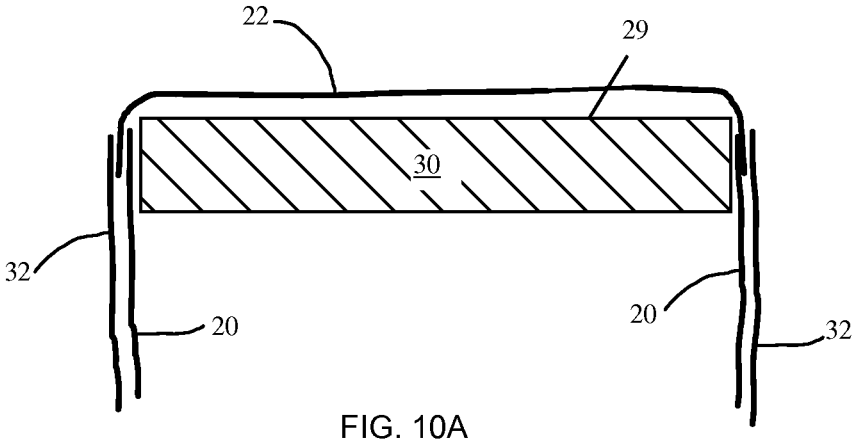
FIG. 10A shows a sectional view of the patient sling and bed cover taken about sectional line 10-10 of FIG. 2, according to an example embodiment of the present disclosure.

With reference now to FIG. 2, the transfer sheet 10 can be seen draped over a bed 30. The substantially rectangular sheet element 22 covers the entirety of the top surface 29 of the bed 30 and in particular of a hospital bed mattress 31 provided on the bed 30. The side edges 28 of the sheet 22 and, in particular the strengthening webbing 24, may lie beyond the lateral extent of the bed and mattress (i.e., preferably on a portion of the sheet 22 that does not overly the mattress as shown in FIG. 10A, although the side edges 28 and/or webbing 24 may overlie the mattress to a minimal degree as shown by example in FIG. 10B as long as the side edges 28 and the webbing 24 are excluded from that region or zone of the sheet 22 that contacts a patient's body such as region 13, such that the webbing 24 and straps 20 do not cause discomfort to the patient 12 when lying on the bed, especially when lying in a central region or zone 13, 13A, 13B typical of conventional and centered patient placement (see FIGS. 2, 9A and 9B). In this context, webbing 24 and/or straps 20 constitute protrusions that may promote the formation of pressure ulcers if a patient were to lie on them for extended periods of time. Other such protrusions may include, but are not limited to, fasteners such as snaps, zippers, Velcro fabrics, and raised appliques. Protrusions generally do not include the discrete irregularities that may be formed by the weave or knit pattern of the sheet's 22 base fabric.

As can be seen, the substantially rectangular sheet portion 22 provides a smooth surface with preferably no stitch lines, no seams, no burrs, no slubs, no protrusions (i.e., straps, fasteners, etc.) or other surface irregularities which might cause patient discomfort and/or promote the formation of decubitus ulcers, especially when the patient is located in the central patient contact zone or region 13, 13A, 13B. The use of a material with a single layer meets the International Pressure Ulcer Treatment and Prevention Guidelines and also maximises the effect of selectively inflatable mattresses commonly used for bed ridden patients.

Figure 10B:
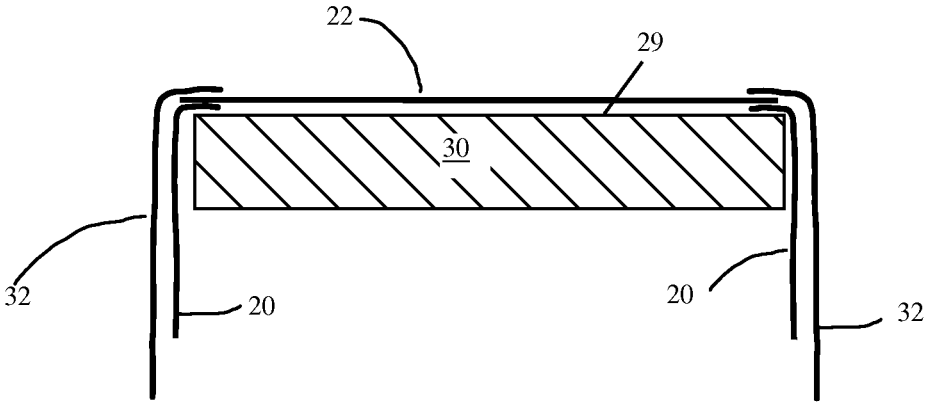
FIG. 10B shows a sectional view similar to that of FIG. 10A, with the side edges of the sling and bed cover resting on the top surface of the mattress towards the outer edge, according to an example embodiment.

The transfer sheet 10 can be seen also with side valances 32 which drape from the edges of the rectangular sheet portion 22 and in particular from the webbing 24. FIG. 2 shows only one of the side valances 32, the other side valance being on the other side of the bed not visible in the view of FIG. 2. As can be seen in FIG. 2 and FIGS. 10A and 10B, also, the straps 20 underlie the side valances 32 so as to be substantially hidden from view when the transfer sheet 10 is draped over the bed 30 as a bed sheet. The transfer sheet 10 thus looks like a normal bed sheet and acts as a suitable substitute. Furthermore, the side valances will prevent people and equipment from becoming caught up in the straps 20. In this regard, it is advantageous to have straps 20 that are either shorter than the drop of the side valances 32 or straps that are otherwise looped so that they do not extend below the hanging edge of the side valances 32 so that they do not drape to the floor and remain visually concealed when the transfer sheet 10 is on a bed.

In some embodiments, as shown below, the ends of the straps 20 attached to the edges of the substantially rectangular sheet portion 22 may be visible at the junction between the sheet portion 22 and the side valances 32. This can act as an indicator to a care worker that the transfer sheet 10 is not a normal bed covering but is a transfer sheet of the type disclosed therein.

Figure 3:
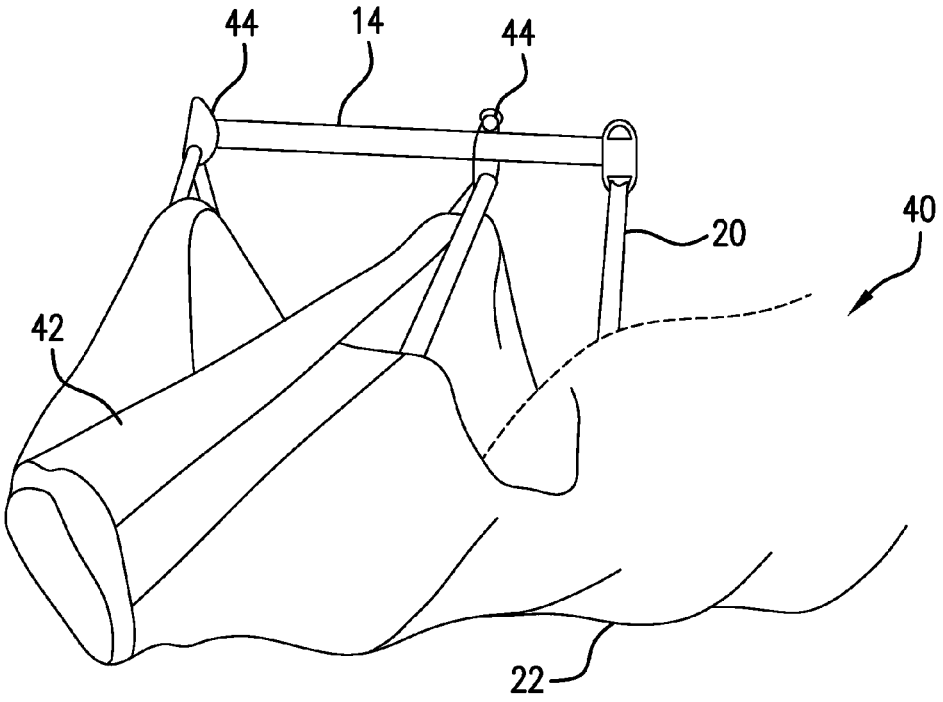
FIG. 3 is a view of a foot end of an exemplary embodiment of combined patient sling and bed cover.

Referring now to FIG. 3 there is shown an embodiment of bed transfer sheet 40 provided with straps 20 as with the embodiment of FIGS. 1 and 2, coupled to a substantially rectangular sheet portion 22. In addition to the straps 20, the embodiment of FIG. 3 includes one or more straps 42 attached to one end of the substantially rectangular sheet portion 22 so as to act as a foot support at the foot end of the transfer sheet 10. The additional strap or straps 42 will hook into an appropriate hook/lug 44 of a hoist 14. The embodiment of FIG. 3 is otherwise the same as the embodiments of FIGS. 1 and 2. Other embodiments may have additional straps at the head end of the transfer sheet 10 or at both ends.

FIGS. 4 to 8 show various structures for the transfer sheet 10, 40 disclosed herein.

Figure 4:
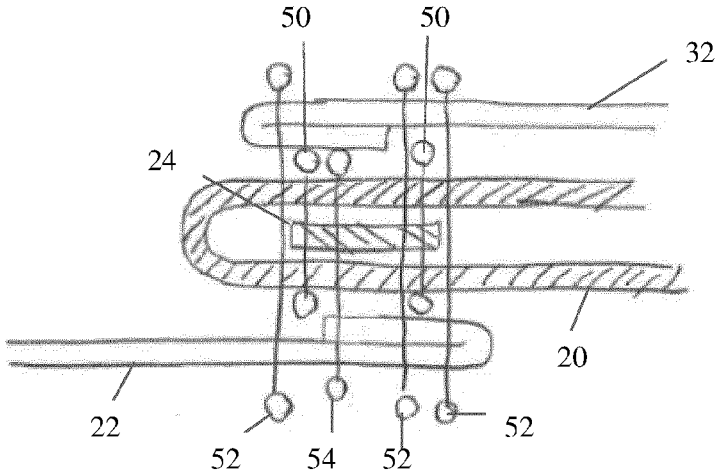
FIGS. 4 to 8 show different configurations of patient sling and bed cover, illustrating how one or more valences may be connected to a sheet portion.

Referring to FIG. 4 first, a portion of the substantially rectangular sheet 22 can be seen at the bottom of the Figure, while a portion of one of the valances 32 is shown at the top of the Figure and extending to the right as viewed. The strap 20 has one end which is looped around a support webbing 24 and then stitched. Stitching is applied not just through the lengths of the strap 20 and webbing 24 individually by means of sutures 50, but is applied also through the thickness of the material formed with sheet 22 and valance 32, by sutures 52. Strength can be added also by means of a suture 54 passing through the sheet 22, the strap 20 and the webbing 24. This additional stitching takes into account the fact that it is the sheet 22 which will take the weight of the patient 12, whereas the valances 32 in certain embodiments will take the patient weight, and will not in other embodiments. Thus, it is possible to make the valences from a lighter-weight fabric having less strength than the base fabric of the sheet 22.

In the example shown in FIG. 4, as with the other examples of FIGS. 5 to 8 equally, the strap 20 which is looped around the webbing 24 may have one end which terminates just beyond the webbing 24 such that the portion of strap 20 which is then attached to the hoist 14 is of a single thickness and is additionally shown to not extend in the same direction as the sheet 22, but rather extends in the same direction as the nearest valence 32. In other embodiments there may be a double strap formed from both sides of the loop, in which case there may be two separate strap portions or these may be sewn together for integrity.

Of course, the sutures 50 to 54 may extend, as appropriate, along the width of the straps 20 and also across those portions of the sheet 22 and valance 32 between the straps 20 so as to secure these portions properly together. The stitching 50, 52 and 54 may be formed in a circle as shown in FIG. 1 and then in a line along the parts of the sheet 22 between the straps 20.

As will be apparent from FIG. 4 also, the edges of the sheet 22 and valance 32 may be folded over one another to add strength to the structure. Thus, while the portion of the sheet 22 that will contact a patient is preferably a single layer of fabric, the reinforced structure connecting the sheet 22 to the valance 32 may have multiple layers to increase strength. Furthermore, the straps 20 may be attached to these multi-layered reinforced structures in order to increase the holding capacity with respect to weight of the transfer sheet 10.

Figure 5:
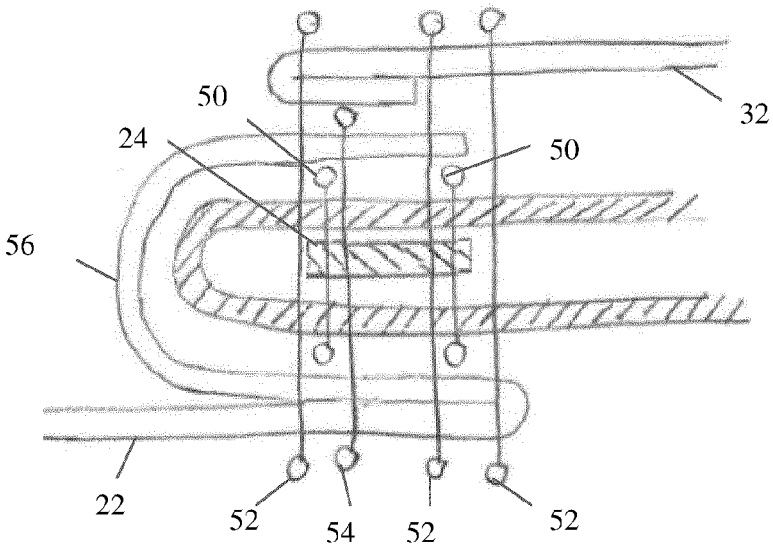

The embodiment of FIG. 5 is similar to that of FIG. 4, apart from the fact that edge 56 of the sheet 22 folds back over the sheet 22 and over the strap 20, thereby to conceal the strap 20 completely from view when the sheet and valance are draped over a bed.

FIG. 6 shows another arrangement in which there is provided a double strengthening web 24, although in some embodiments this may be a single strengthening web 24 with apertures at regular intervals along the length of the webbing.

With reference to FIG. 7, this is similar to the embodiment of FIG. 6, with the primary difference being that the strap 20 has one end which passes underneath one of the webbings 24 and over the other webbing 24, as shown in FIG. 7.

With reference to FIG. 8, this is similar to the embodiment of FIG. 5, although the edge of the valance 32 extends over the looped edge 56 of the sheet 22 in the manner shown in the Figure.

It will be appreciated that the features of the different embodiments of FIGS. 4 to 8 can be combined with one another, such as, for example, to have the arrangements or webbing and strap shown in these Figures with or without a cover provided by either the sheet 22 or the webbing 32 (the latter not shown in the drawings) or both.

In use, the transfer sheet 10 can be used both as a sling and as bed linen replacement that is to be left underneath the patient once the patient has been transferred to a bed 30. In this regard, once the patient has been transported over the bed as shown in FIG. 1, the patient is slowly lowered onto the bed mattress and the straps are then released from the hoist 14, allowing the transfer sheet 10 to drape over the bed. The valances 32 are then draped over the bed sides to hide the straps 20, in the manner shown in FIG. 2. As the rectangular sheet portion 22 of the transfer sheet 10 provides an undisturbed flat surface, this can act as a sheet without requiring any other bed covering. In this regard, the patient may remain on the bed covering for extended periods of time. In certain embodiments, the bed covering includes only a single thickness of material to comply with the International Pressure Ulcer Treatment and Prevention Guidelines. This is particularly advantageous when the mattress of the bed is selectably inflatable, as is known in the art and of the types provided by the applicant.

It will be apparent that the side valances 32 are not essential to the transfer sheet but simply preferable for hiding the straps 20 and for preventing inadvertent entanglement with the straps. Although the preferred embodiments provide valances which are secured, preferably by stitching, to the sheet 22, other embodiments provide valances 32 which can be subsequently attached to the edge of the rectangular sheet 22, for example with Velcro™ buttons, press fasteners, zips or the like.

Another advantage of the valances 32 is shown in FIG. 1. When the patient 12 is held in and supported by the transfer sheet 10 attached to the lift 14, the valances 32 may be folded over the patient so as to provide the patient with a cover. In this covering position, the valances 32 serve to keep the patient warm and may help keep the patient within the sling during transfer, and/or help the patient to remember to keep hands and arms within the sling formed by the transfer sheet 10.

In the case of embodiments using additional straps as shown in FIG. 3, the patient's feet and head could be additionally supported during the transfer process.

The provision of a plurality of straps 20 which are spaced along the longitudinal sides of the rectangular sheet portion 22 enables a patient to be transported whilst lying substantially flat. They also enable the patient to be transported in a tilted or sitting position by adjustment of the lengths of the straps 20 as appropriate or by attaching only some of the straps to the hoist 14, for example by leaving the straps 20 at the foot end of the transfer sheet 10 unattached so that the patient's legs can dangle. Similarly, a tilted or sitting position of the patient can be achieved by tightening the straps 20 at the head/torso end of the transfer sheet 10. In this manner, a patient can be transported between a bed and a seat or chair and vice versa with the transfer sheet 10 and particularly by adjustment of the straps 20.

Use of transfer sheet 10, 40 avoids having to apply and remove slings or using sliding aids at each transfer, which can be uncomfortable to the patient and difficult as well as time consuming for the care giver. Moreover, the transfer sheet avoids the risk of a patient being transferred manually when sliding aids or slings are not readily available close to the patient. Furthermore, the improvement in patient handling by use of the transfer sheets 10, 40 can substantially remove or minimise the risk that tubes and feed lines attached to the patient being inadvertently removed. It will be appreciated that the transfer sheet 10, and in particular the rectangular sheet portion 22, is best made of a fabric which has similar properties to standard bed linen and in particular a fabric which is breathable and soft.

In certain embodiments, the transfer sheet has seven straps 20 on either side of the rectangular sheet portion 22 (although only 5 are shown in the drawings). In other embodiments, a mattress/transfer-sheet system is disclosed, in which a generally rectangular shaped mattress 30 having a length and width is employed with a transfer-sheet 10 as described herein, having a rectangular sheet portion 22 preferably sized in reference to the mattress 30. In various embodiments, the transfer sheet is sized to have a length to be no smaller than five percent shorter than the length of the mattress, and a width no shorter than 10 percent of the width of the mattress, and in other embodiments no shorter than 5 percent of the width of the mattress. Such a transfer sheet may have one or both of its length and width to be about the same as the mattress, or 5 percent longer than, 10 percent longer than, or 15 percent longer than the respective dimensions of the mattress. Other embodiments will be apparent to the skilled person having regard for the teachings herein and the claims which follow.

The invention claimed is:

1. A combined patient sling and bed covering forming a bed sheet, and comprising:

a substantially rectangular sheet comprising at least one layer of material, wherein the substantially rectangular sheet includes a central patient contact zone constructed to overlie a portion of an upper surface of a bed mattress and to provide a contact surface for a patient, wherein the central patient contact zone has an undisturbed surface free of surface irregularities; and a plurality of coupling elements fixed to the substantially rectangular sheet at points outside of the central patient contract zone, wherein the plurality of coupling elements are constructed to attach the combined patient sling and bed covering to a lifting device; and first and second side valences attached to, integral with, or attachable to, first and second longitudinal sides of the sheet, wherein when the sheet overlies a bed mattress, the first and second side valences drape along sides of the bed so as to substantially hide one or more of the plurality of coupling elements from view because each draping coupling element is shorter than a drop of the side valance that is hiding the coupling element, and wherein the bed sheet is dimensioned and configured as a standard bed sheet.

2. A combined patient sling and bed covering according to claim 1, wherein the surface irregularities that the undisturbed surface is free of are protrusions including webbing, or straps, or both webbing and straps.

3. A combined patient sling and bed covering according to claim 1, wherein the surface irregularities that the undisturbed surface is free of are seams.

4. A combined patient sling and bed covering according to claim 1, wherein the surface irregularities that the undisturbed surface is free of are stitch lines.

5. A combined patient sling and bed covering according to claim 1, wherein the surface irregularities that the undisturbed surface is free of are selected from the group consisting of protrusions, seams, stitch lines and burrs.

6. A combined patient sling and bed covering according to claim 1, wherein the sheet is able to support a weight of at least 75 kilograms.

7. A combined patient sling and bed covering according to claim 1, wherein the sheet has a length of at least 170 cm and a width of at least 70 cm.

8. A combined patient sling and bed covering according to claim 1, wherein the coupling elements are disposed along longitudinal opposing sides of the sheet, and are substantially evenly spaced along the longitudinal opposing sides of the sheet.

9. A combined patient sling and bed covering according to claim 1, including at least one coupling element disposed along at least one transverse side of the sheet.

10. A combined patient sling and bed covering according to claim 1, wherein the coupling elements include straps.

11. A combined patient sling and bed covering according to claim 10, wherein the straps are attached to a portion of the sheet that does not overlie the upper surface of the bed mattress, and the straps are length adjustable.

12. A combined patient sling and bed covering according to claim 1, further including a reinforcement element extending along two opposing sides of the sheet and wherein all of the reinforcement elements are disposed outside the central patient contact zone.

13. A combined patient sling and bed covering according to claim 12, wherein the reinforcement element comprises webbing disposed on side edges of the sheet and a folded over portion of the sheet.

14. A combined patient sling and bed covering according to claim 1, wherein the central patient contact zone has the shape of a rectangle, or oval, or a body outline, the body outline having a main trunk portion, two arm portions, two leg portions, and a head portion.

15. A combined patient sling and bed covering according to claim 1, wherein the coupling elements are accessible when the side valances are attached to the sheet.

16. A combined patient sling and bed covering according to claim 15, wherein the coupling elements at least partially extend over the side valances.

17. A combined patient sling and bed covering according to claim 1, wherein when the sheet is connected to a lifting device so as to lift a patient, the first and second valences are positioned to cover the patient.

18. A combined patient sling and bed covering according to claim 1, wherein the sheet is made of a microfiber fabric comprising synthetic fibers having a denier of less than 1.

19. A combined patient sling and bed covering according to claim 18, wherein the microfiber fabric has a twill weave, and the synthetic fibers are polyester, nylon, or a conjunction of polyester and nylon.

20. A combined patient sling and bed covering comprising:

a substantially rectangular sheet comprising at least one layer of material, wherein the substantially rectangular sheet includes a central patient contact zone constructed to overlie a portion of an upper surface of a bed mattress and to provide a contact surface for a patient, wherein the central patient contact zone has an undisturbed surface free of surface irregularities;

a plurality of coupling elements fixed to the substantially rectangular sheet at points outside of the central patient contract zone, wherein the plurality of coupling elements are constructed to attach the combined patient sling and bed covering to a lifting device;

a first side valence attached to, integral with, or attachable to, a first longitudinal side of the sheet; and a second side valence attached to, integral with, or attachable to, a second longitudinal side of the sheet, wherein when the sheet overlies the bed mattress, the first valence and the second valence drape along sides of the bed mattress so as to substantially hide one or more of the plurality of coupling elements from view, wherein the plurality of coupling elements comprise a plurality of straps, and wherein each strap is shorter than a drop of that one of the first side valance and the second side valance that conceals the strap.

21. A combined patient sling and bed covering according to claim 20, wherein the combined patient sling and bed covering is dimensioned and configured as a bed sheet comprising microfiber fabric that has a twill weave and synthetic fibers having a denier of less than 1, and the central patient contact zone does not include straps or webbing.

* * * * *